US005234805A

United States Patent [19]

Tang et al.

[11] Patent Number: 5,234,805

[45] Date of Patent: Aug. 10, 1993

[54] PHOTOGRAPHIC MATERIAL AND PROCESS COMPRISING A PYRAZOLOTRIAZOLE COUPLER

[75] Inventors: Ping-Wah Tang, Rochester; Sundaram Krishnamurthy, Penfield; Stanley W. Cowan, Rochester, all of N.Y.

[73] Assignee: Eastman Kodak Corporation, Rochester, N.Y.

[21] Appl. No.: 841,819

[22] Filed: Feb. 26, 1992

[51] Int. Cl.[5] ..... G03C 7/38

[52] U.S. Cl. ..... 430/558; 430/386; 430/387

[58] Field of Search ..... 430/558, 386, 387

[56] References Cited

U.S. PATENT DOCUMENTS

| | | | |
|---|---|---|---|
| 4,540,654 | 9/1985 | Sato et al. | 430/381 |
| 4,559,297 | 12/1985 | Seto et al. | 430/551 |
| 4,618,573 | 10/1986 | Okamura et al. | 430/558 |
| 4,621,046 | 11/1986 | Sato et al. | 430/381 |
| 4,735,893 | 4/1988 | Morigaki et al. | 430/551 |
| 4,748,100 | 5/1988 | Umemoto et al. | 430/505 |
| 4,753,870 | 6/1988 | Takada et al. | 430/546 |
| 4,822,730 | 4/1989 | Furutuchi et al. | 430/558 |
| 4,830,956 | 5/1989 | Waki | 430/558 |
| 4,845,022 | 7/1989 | Wolff | 430/558 |

FOREIGN PATENT DOCUMENTS

| | | | |
|---|---|---|---|
| 0119860 | 9/1984 | European Pat. Off. . | |
| 0240568 | 10/1987 | European Pat. Off. . | |
| 279338 | 12/1987 | Japan | 430/558 |

*Primary Examiner*—Lee C. Wright

*Attorney, Agent, or Firm*—Wegner, Cantor, Mueller & Player

[57] ABSTRACT

Pyrazolotriazole couplers having a ballast-containing group of the formula (I) attached to the pyrazolotriazole ring group (I)

wherein:

R, $R^2$, $R^a$ and $R^b$ represent hydrogen or a substituent;

L is a divalent linking group connecting the ballast containing group to the pyrazolotriazole ring;

L' is a linking group connecting the —BD group to the phenylene ring;

n is 0 or 1;

B represents $—N(R^c)—SO_2—$, wherein $R^c$ represents hydrogen or a substituent; and D represents substituted or unsubstituted alkyl are useful in silver halide photographic materials and processes. The couplers exhibit increased coupling efficiency, and provide formation of dyes having improved maximum magenta image dye density when employed in color photographic materials and processes.

12 Claims, No Drawings

PHOTOGRAPHIC MATERIAL AND PROCESS COMPRISING A PYRAZOLOTRIAZOLE COUPLER

This invention relates to novel pyrazolotriazole dye-forming couplers and to photographic silver halide materials and processes using such couplers.

Color images are customarily obtained in the photographic art by reaction between an oxidation product of a silver halide developing agent and a dye-forming coupler. Pyrazolone couplers are useful for forming magenta dye images; however, pyrazoloazole couplers, particularly pyrazolotriazole couplers, represent another class of couplers for this purpose. Examples of pyrazolotriazole couplers are described in, for example, U.S. Pat. No. 4,443,536; U.S. Pat. Nos. 1,247,493; 1,252,418; and 1,398,979; and U.S. Pat. Nos. 4,665,015; 4,514,490; 4,540,654; 4,590,153; 4,822,730 and European Patent 177765. One class of pyrazolotriazole couplers includes 1H-pyrazolo[1,5-b][1,2,4] triazole couplers.

U.S. Pat. Nos. 4,540,654 and 4,621,046 describe 1H-pyrazolo[1,5-b][1,2,4] triazole couplers for overcoming the problem of unwanted absorption around 430 nm which causes color turbidity. However, although these couplers may overcome the unwanted absorption problem, the conversion of the coupler into an azomethine dye is low when processing under the condition of forming a sufficient amount of the oxidation product of an aromatic primary amine developing agent in the silver halide emulsion. In other words, the coupling efficiency and the maximum coloring density ($D_{max}$) are reduced.

For increasing the coupling efficiency, U.S. Pat. No. 4,822,730 discloses certain ballast groups comprising a sulfonamido group. An example of such a pyrazolotriazole coupler is represented by the following formula:

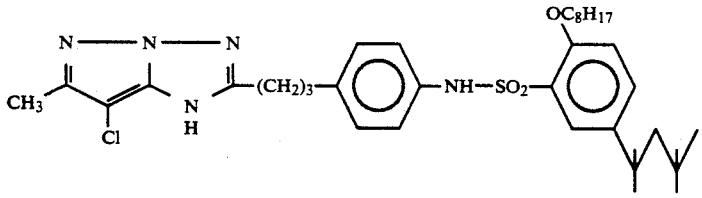

However, such couplers still do not exhibit sufficient coupling efficiency.

Accordingly, it is an objective of the present invention to provide novel pyrazolotriazole couplers exhibiting increased coupler efficiency, increased coupler reactivity and improved $D_{max}$. Another objective is to provide pyrazolotriazole couplers with improved dispersability. A further objective is to provide silver halide photographic materials comprising such couplers.

The couplers contain a group of the following formula (I) attached to the pyrazolotriazole ring group:

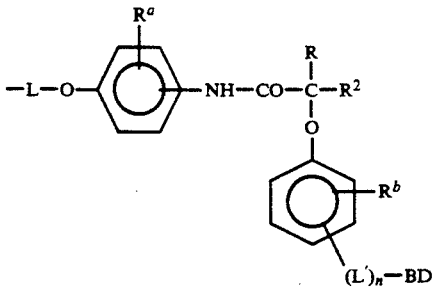

(I)

wherein:

R and $R^2$ independently represent hydrogen or a substituent;

$R^a$ and $R^b$ independently represent hydrogen or a substituent;

L is a divalent linking group connecting the ballast containing group to the pyrazoloazole ring;

L' is a divalent linking group connecting the —BD group to the phenylene ring;

n is 0 or 1;

B represents $—N(R^c)—SO_2—$, wherein $R^c$ represents hydrogen or a substituent; and D represents substituted or unsubstituted alkyl.

It has been found that pyrazolotriazole couplers containing the group of formula (I) enable the formation of dyes which exhibit improved $D_{max}$, improved coupler efficiency, increased coupler reactivity and improved dispersability when employed in color photographic materials and processes. While not wishing to be bound by theory, it is believed that the combination of the BD group, the aryloxy group to which the BD group is linked, and the aryloxy group linked to the pyrazolotriazole ring provides the objective improvement in these properties.

An embodiment of the invention is a photographic element comprising a support bearing at least one photographic silver halide emulsion layer and a dye-forming pyrazolotriazole coupler wherein the dye-forming coupler contains a group of formula (I) attached to the pyrazolotriazole ring group.

A typical coupler as described is represented by the formula (II):

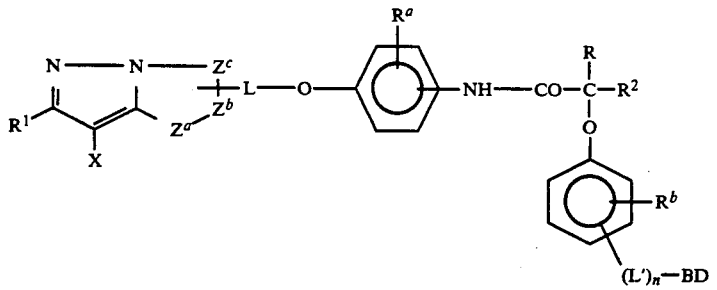

(II)

wherein:

R, $R^2$, $R^a$, $R^b$, L, L', n, B and D are as previously defined;

$R^1$ represents H or a coupler substituent;

X is hydrogen or a coupling-off group known in the photographic art; and $Z^a$, $Z^b$ and $Z^c$ are independently a substituted or unsubstituted methine group, =N—, =C— or —NH—, provided that one of either the $Z^a$—$Z^b$ bond or the $Z^b$—$Z^c$ bond is a double bond and the other is a single bond, and when the $Z^b$— $Z^c$ bond is a carbon-carbon double bond, it may form part of an aromatic ring, and at least one of $Z^a$, $Z^b$ and $Z^c$ represents a methine group connected to group L.

A preferred coupler contains a 1H-pyrazolo[1,5-b][1,2,4] triazole group and is represented by the formula (III):

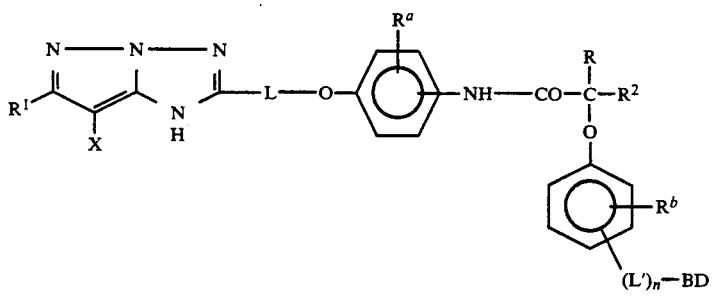

(III)

wherein R, R, $R^2$, $R^a$, $R^b$, L, L', n, B, D, $R^1$, and X are as previously defined.

Illustrative examples of useful couplers as described are as follows:

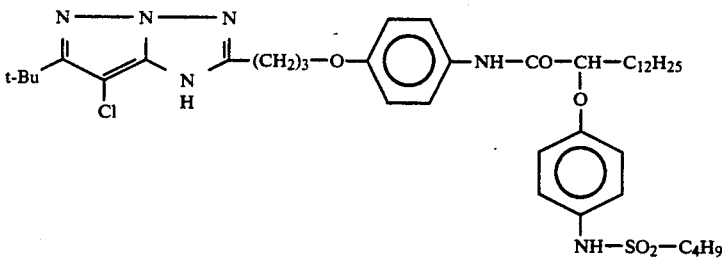

M-1

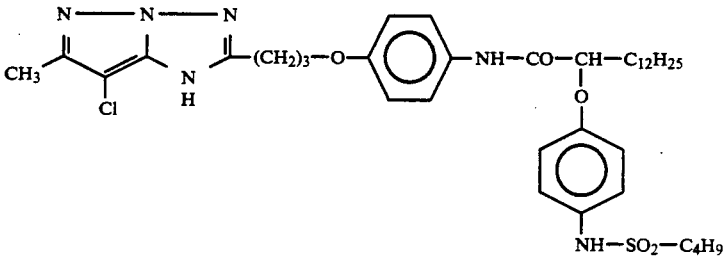

M-2

-continued
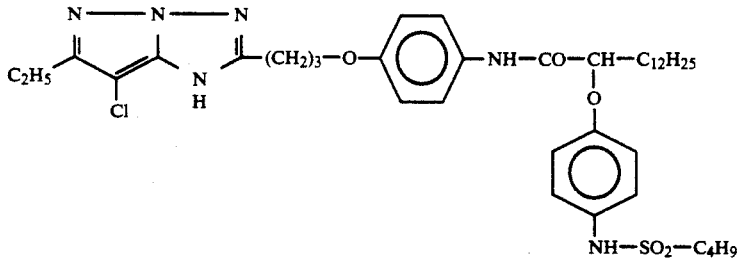
M-3
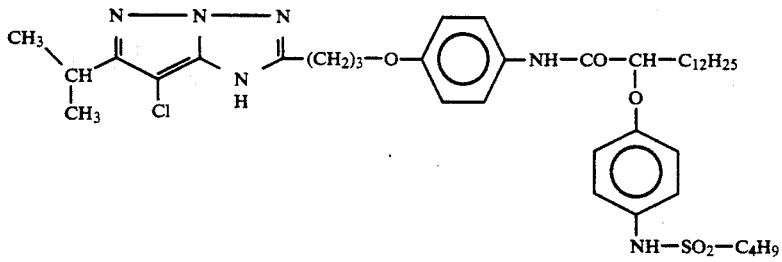
M-4
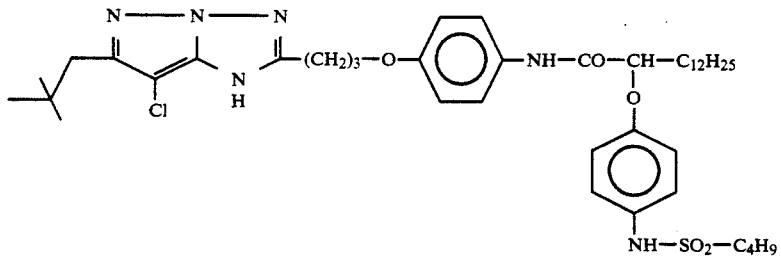
M-5
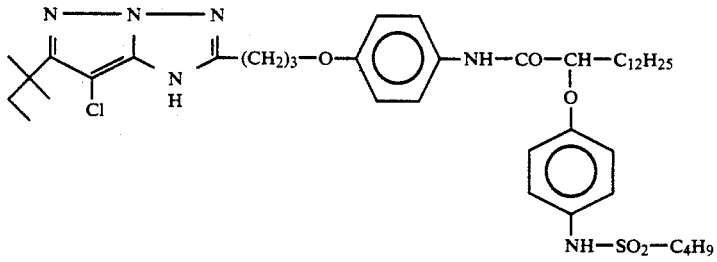
M-6
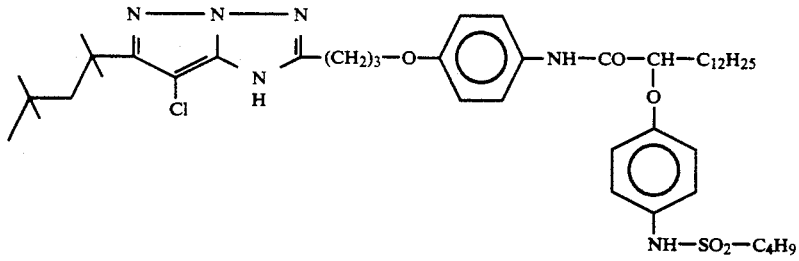
M-7
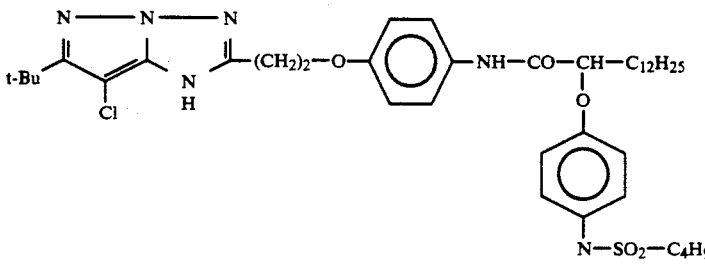
M-8

-continued
M-9
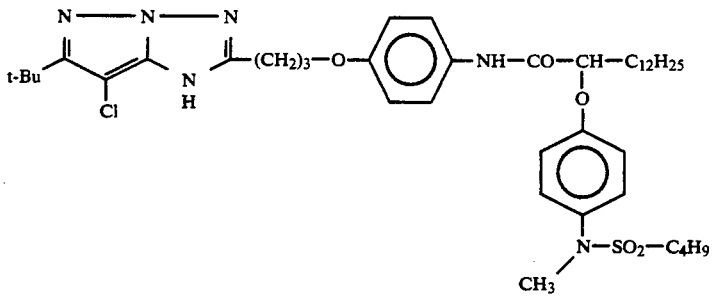
M-10
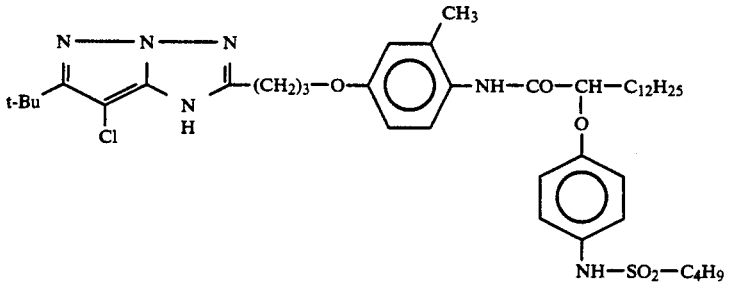
M-11
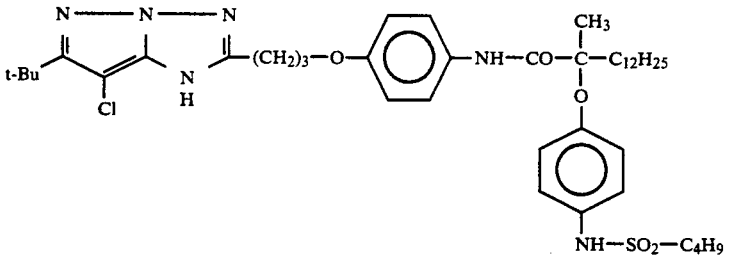
M-12
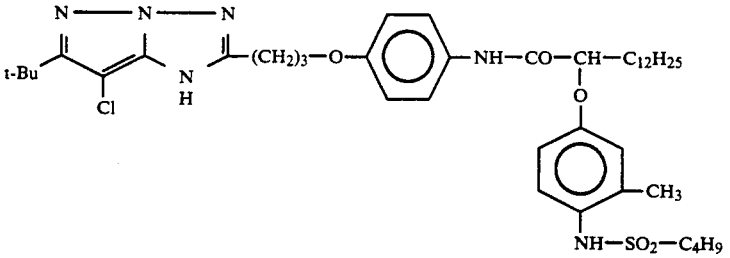
M-13
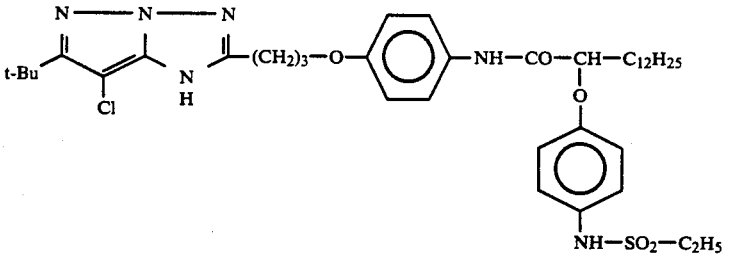
M-14
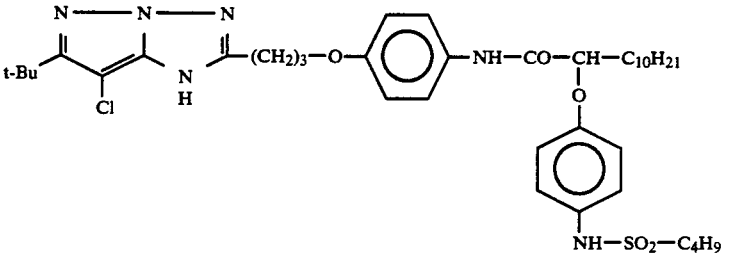

-continued

M-15

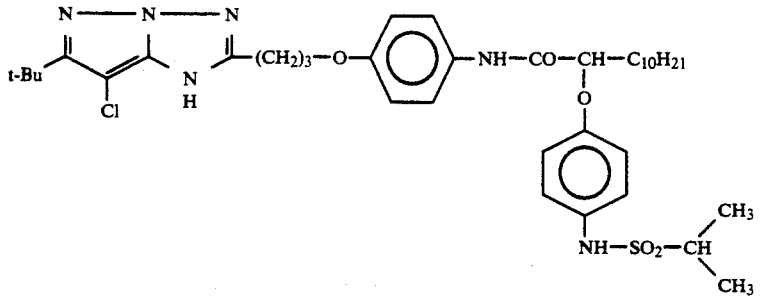

M-16

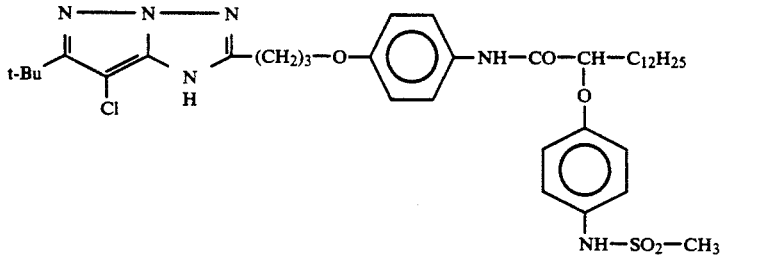

M-17

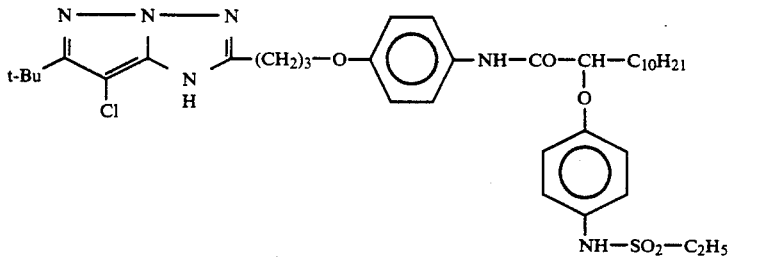

M-18

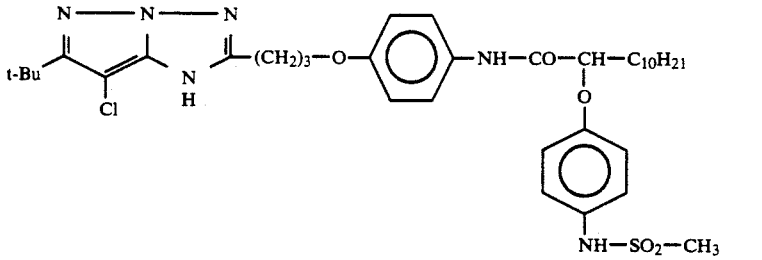

M-19

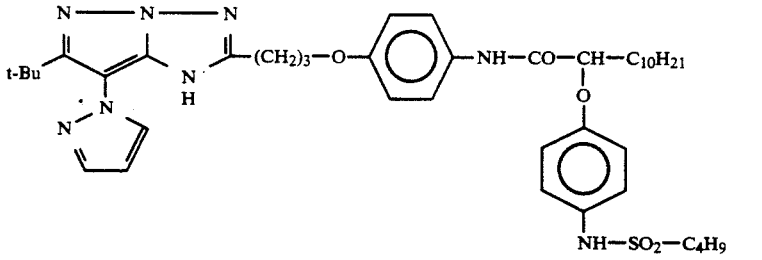

In the above formulae, $R^1$ is hydrogen or a substituent group known in the art which typically promotes solubility, diffusion resistance or dye hue or dye stability of the dye formed upon reaction of the coupler with the oxidized color developing agent.

Examples of substituent groups for $R^1$ include: an alkyl group which may be straight or branched, and which may be substituted, such as methyl, ethyl, n-propyl, n-butyl, t-butyl, trifluoromethyl, tridecyl or 3-(2,4-di-t-amylphenoxy) propyl; an alkoxy group which may be substituted, such as methoxy or ethoxy; an alkylthio group which may be substituted, such as methylthio or octylthio; an aryl group, an aryloxy group or an arylthio group, each of which may be substituted, such as phenyl, 4-t-butylphenyl, 2,4,6-trimethylphenyl, phenoxy, 2-methylphenoxy, phenylthio or 2-butoxy-5-t-octylphenylthio; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; cyano; an acyloxy group which may be substituted, such as acetoxy or hexadecanoyloxy; a carbamoyloxy group which may be substituted, such as N-phenylcarbamoyloxy or N-ethylcarbamoyloxy; a silyloxy group which may be substituted, such as trimethylsilyloxy; a sulfonyloxy group which may be substituted, such as dodecylsulfonyloxy; an acylamino group which may be substituted, such as acetamido or benzamido; an anilino group which may be substituted, such as phenylanilino or 2-chloroanilino; an ureido group which may be substituted, such as phenylureido or methylureido; an imido group which may be substituted, such as N-succinimido or 3-benzylhydantoinyl; a sulfamoylamino group which may be substituted, such as N,N-dipropylsulfamoylamino or N-methyl-N-decylsulfamoylamino.

Additional examples of substituent groups for $R^1$ include: a carbamoylamino group which may be substituted, such as N-butylcarbamoylamino or N,N-dimethyl-carbamoylamino; an alkoxycarbonylamino group which may be substituted, such as methoxycarbonylamino or tetradecyloxycarbonylamino; an aryloxycarbonylamino group which may be substituted, such as phenoxycaronylamino or 2,4-di-t-butylphenoxycarbonylamino; a sulfonamido group which may be substituted, such as methanesulfonamido or hexadecanesulfonamido; a carbamoyl group which may be substituted, such as N-ethylcarbamoyl or N,N-dibutylcarbamoyl; an acyl group which may be substituted, such as acetyl or (2,4-di-t-amylphenoxy)acetyl; a sulfamoyl group which may be substituted such as N-ethylsulfamoyl or N,N-dipropylsulfamoyl; a sulfonyl group which may be substituted, such as methanesulfonyl or octanesulfonyl; a sulfinyl group which may be substituted, such as octanesulfinyl or dodecylsulfinyl; an alkoxycarbonyl group which may be substituted, such as methoxycarbonyl or butyloxycarbonyl; an aryloxycarbonyl group which may be substituted, such as phenyloxycarbonyl or 3-pentadecyloxycarbonyl; an alkenyl group carbon atoms which may be substituted; a carboxyl group which may be substituted; a sulfo group which may be substituted; hydroxyl; an amino group which may be substituted; or a carbonamido group which may be substituted.

Substituents for the above substituted $R^1$ groups include halogen, an alkyl group, an aryl group, an aryloxy group, a heterocyclic or a heterocyclic oxy group, cyano, an alkoxy group, an acyloxy group, a carbamoyloxy group, a silyloxy group, a sulfonyloxy group, an acylamino group, an anilino group, a ureido group, an imido group, a sulfonylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, hydroxyl, an amino group or a carbonamido group.

Generally, the above groups and substituents thereof which contain an alkyl group may include an alkyl group having 1 to 16 carbon atoms. The above groups and substituents thereof which contain an aryl group may include an aryl group having 6 to 8 carbon atoms, and the above groups and substituents which contain an alkenyl group may include an alkenyl group having 2 to 6 carbon atoms.

Preferably, $R^1$ represents hydrogen, an alkyl group, an aryl group, a carbonamido group, a sulfonamido group, a sulfone group, a thio group, a sulfoxide group, a ureido group or a multicyclic group.

The pyrazolotriazole contains in the coupling position, represented by X in formulae (II) and (III), hydrogen or a coupling-off group also known as a leaving group.

Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclylimido, thiocyano, alkylthio, arylthio, heterocyclylthio, sulfonamido, phosphonyloxy and arylazo. They are described in, for example, U.S. Pat. Nos. 2,355,169; 3,227,551; 3,432,521; 3,476,563; 3,617,291; 3,880,661; 4,052,212 and 4,134,766; and in U.K. patents and published application numbers 1,466,728; 1,531,927; 1,533,039; 2,006,755A and 2,017,704A; the disclosures of which are incorporated herein by reference. Examples of specific coupling-off groups are

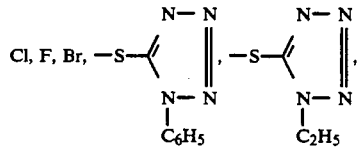

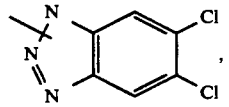

—SCN, —$OCH_3$, —$OC_6H_5$, —$OCH_2CONHCH_2CH_2OH$, —$OCH_2CONHCH_2CH_2OCH_3$, —$OCH_2CONHCH_2CH_2OCOCH_3$, —$NHSO_2CH_3$,

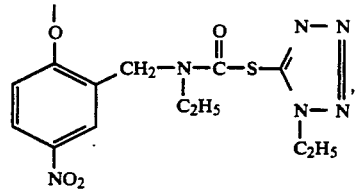

—$NHSO_2CH_3$, —$OCC_6H_5$, —$NHCC_6H_5$,

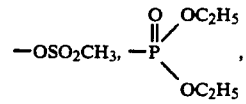

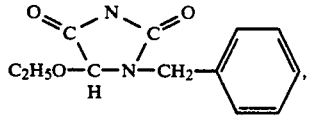

-continued

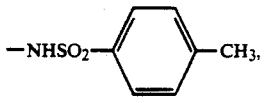

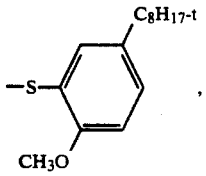

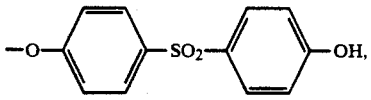

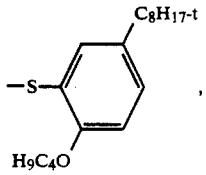

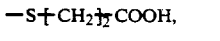

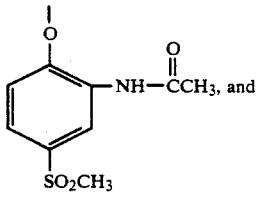

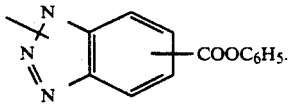

Preferably, X is H or halogen, and more preferably, H or Cl.

$R^a$, $R^b$, R and $R^2$ which may be the same or different, each represents hydrogen or a substituent. In more detail, $R^a$, $R^b$, R and $R^2$ each represents hydrogen, halogen or an aliphatic residue including a straight or branched alkyl or alkenyl or alkynyl group having 1 to 32 carbon atoms, a heterocycle, an aralkyl group, a cycloalkyl group or a cycloalkenyl group. The aliphatic residue may be substituted with a substituent bonded through an oxygen atom, a nitrogen atom, a sulfur atom or a carbonyl group, a hydroxy group, an amino group, a nitro group, a carboxy group, an amido group, cyano or halogen.

Preferably, $R^a$ and $R^b$ represent hydrogen or an aliphatic residue. Preferably, R and $R^2$ are hydrogen or an alkyl group having 1 to 32 carbon atoms.

Preferably, $R^c$ represents hydrogen or an alkyl group having 1 to 16 carbon atoms, such as methyl, ethyl, propyl or butyl. The alkyl group may be straight or branched.

D represents substituted or unsubstituted alkyl which may be straight or branched. The alkyl group may have 1 to 24 carbon atoms. Preferred D groups include methyl, ethyl, propyl, isopropyl, n-butyl, sec-butyl, tert-butyl, pentyl or tert-butyl.

L is a linking group connecting the ballast containing group to the pyrazoloazole ring. A preferred L group is a straight or branched alkyl group having 1 to 6 carbon atoms. Suitable L groups include:

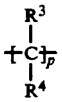

wherein p is an integer of 1 to 6, and $R^3$ and $R^4$, which may be the same or different, each represents hydrogen or a substituent. Preferably, $R^3$ and $R^4$ are independently hydrogen or lower alkyl.

L' is a linking group connecting the —BD group to the phenylene ring. Suitable L' groups include:

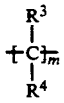

wherein m is 0, 1 or 2, and $R^3$ and $R^4$ are defined previously.

The following portion of formula (I)

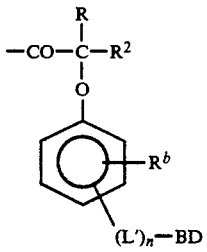

constitutes a ballast group attached to the pyrazolotriazole ring through the group

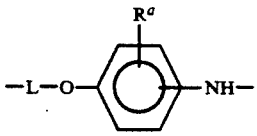

Generally, a ballast group is an organic radical of such size and configuration as to confer on the coupler molecule sufficient bulk to render the coupler substantially non-diffusible from the layer in which it is coated in a photographic element. Thus, the combination of the above variables is chosen to meet this criteria.

Pyrazolotriazole couplers as described can be used in ways and for purposes that pyrazolotriazole couplers have been used in the photographic art.

Pyrazolotriazole couplers as described are prepared by general methods of synthesis described in the art, such as in U.S. Pat. No. 4,540,654. An illustrative synthesis Scheme I is as follows.

Scheme I
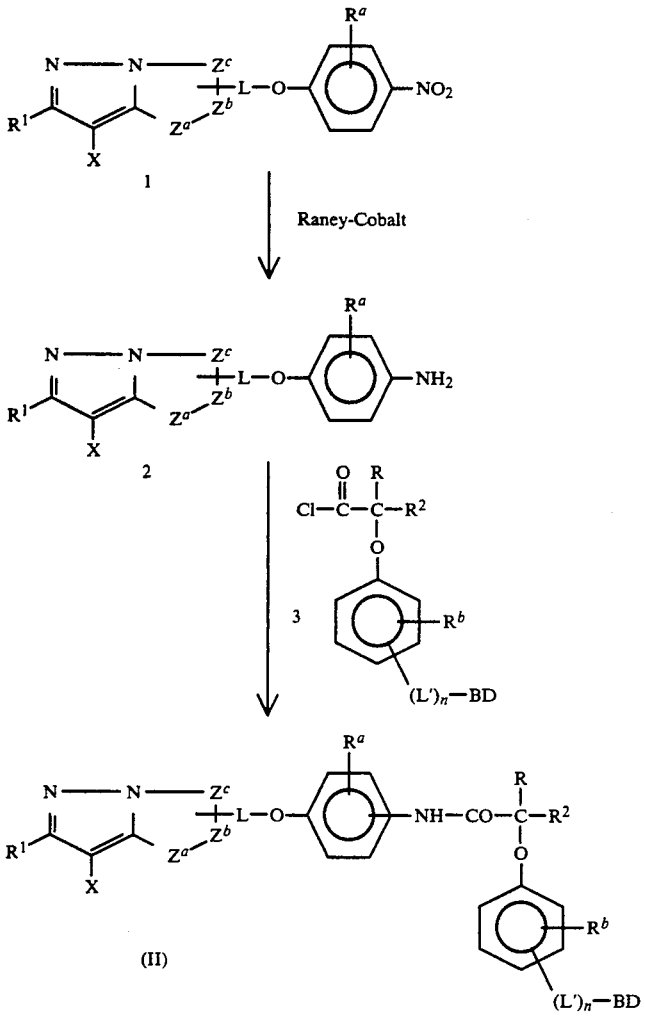
Synthesis Example—Coupler M-1
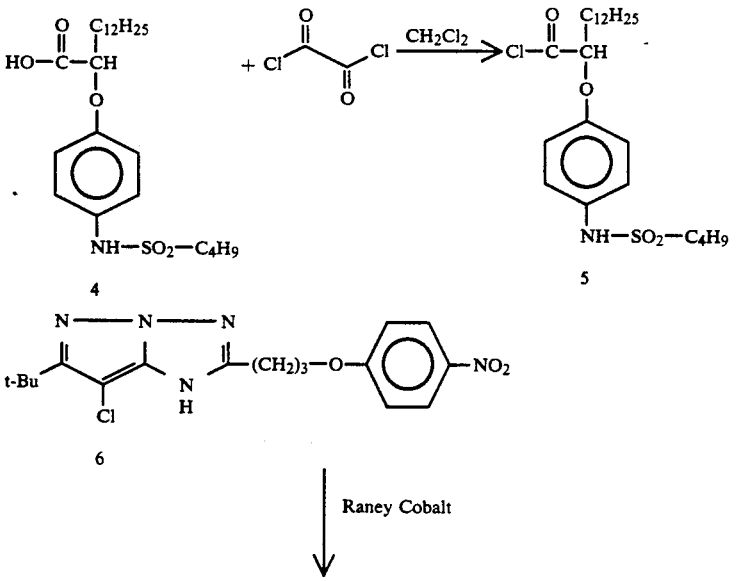

-continued

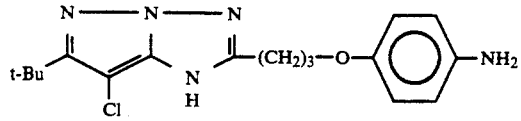

7

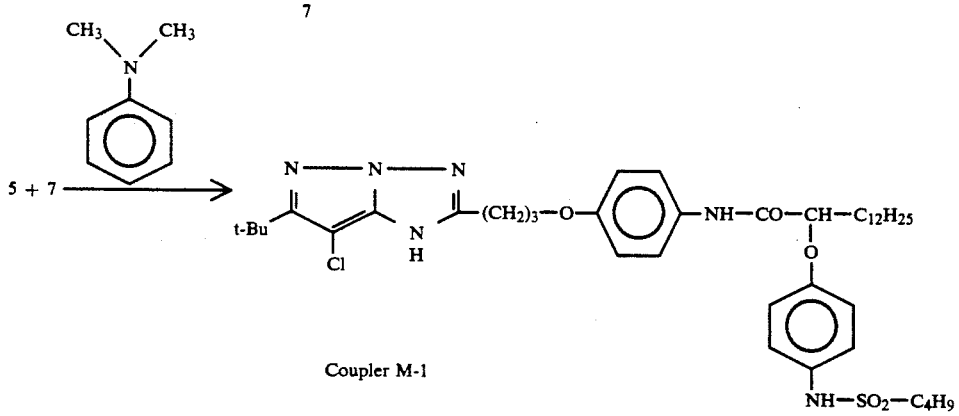

Coupler M-1

The couplers according to this invention can be prepared by following the general scheme I illustrated for coupler M-1.

PREPARATION OF BALLAST ACID CHLORIDE (5)

In a dry, nitrogen purged, 12-L, 4-necked round-bottomed flask, 1,526 g (3.35 mol) of 2-(4-((butylsulfonyl-)amino)phenoxy)-tetradecanoic acid (4) was added 6 liters of dichloromethane at room temperature, followed by the addition of 5 ml of N,N'-dimethylformamide. The mixture was stirred for several minutes, followed by the dropwise addition of 520 g (4.10 mol) of oxalyl chloride. The reaction was stirred for 4 hours. The reaction was complete, as evidenced by methanolysis test. The solvent and the excess of reagents were removed in vacuo and the residue was repeated (three times) treated with dicholoromethane, followed by removal under vacuo to yield the ballast acid chloride (5) which was used immediately in the following step.

REDUCTION OF COUPLER NITRO-COMPOUND (6) TO COUPLER AMINO-COMPOUND (7)

A mixture of 477.30 g (I.26 mol) of coupler nitro-compound (6), 150 g of pre-reduced and washed Raney Cobalt in 7 liters of dry THF at room temperature was subjected to hydrogenation under 500 psi of hydrogen. After the reduction, the catalyst was filtered and the filtrate was concentrated in vacuo to yield a solid. The crude material was purified by recrystallization from acetonitrile (4.50 l) to yield 402 g (92%) of a light brown solid. All the analytical data confirmed the assigned structure.

PREPARATION OF A COUPLER OF THE PRESENT INVENTION (M-1)

A stirred mixture of 1165.3 g (3.35 mol) of coupler amino-compound (7) and 400 g (3.3I mol) of N,N-dimethylaniline in 5 liters of acetonitrile was cooled to 0° C., followed by the addition of the ballast acid chloride in 2 liters of $CH_3CN$ over a period of 45 minutes. The reaction was allowed to warm to room temperature and was stirred overnight. The reaction was complete, as evidenced by TLC analysis. The solid was collected in vacuo. The filtrate was poured into 60 liters of cold water containing 350 ml of concentrated hydrochloric acid. The resulting precipitate was collected. The solid and the precipitate were combined, and slurried with 40 l of water at 60° C. The solid was collected, washed with water (40° C.) and dried under suction. The crude material was purified by recrystallization from acetonitrile (16 1) to yield 2040 g (78%) of a white solid (M-1). HPLC analysis: 97.3%. All analytical data confirmed the assigned structure (M-1 ).

Alternate methods of synthesis are also disclosed in the following applications filed concurrently with the present application, the disclosures of which are incorporated by reference: P. Tang and T. Mungal, "Process for Preparation of 1H-Pyrazolo [1,5-b][1,2,4]Triazole Couplers and Intermediate Compounds Employed in the Process", Ser. No. 841,484; P. Tang and T. Mungal, "Process for Preparation of 1H-Pyrazolo [1,5-b][1,2,4] Triazole Compounds by Cyclization of N-(4-Substituted-Pyrazolyl)Amidoxime", Ser. No. 841,463; P. Tang and T. Mungal, "Process of Preparing N-(4-Chloropyrazolyl) Amidoxime", Ser. No. 841,462; and P. Tang, "Method of Preparing 5-Amino-3-Substituted-Pyrazole", Ser. No. 841,469.

The couplers of this invention can be incorporated in silver halide emulsions and the emulsions can be coated on a support to form a photographic element. Alternatively, the couplers can be incorporated in photographic elements adjacent the silver halide emulsion where, during development, the coupler will be in reactive association with development products such as oxidized color developing agent.

The photographic elements can be either single color or multicolor elements. In a multicolor element, the magenta dye-forming coupler is usually associated with a green-sensitive emulsion, although they could be associated with an unsensitized emulsion or an emulsion sensitized to a different region of the spectrum. Multicolor elements contain dye image-forming units sensitive to each of the three primary regions of the spectrum. Each unit can be comprised of a single emulsion layer or of multiple emulsion layers sensitive to a given region of the spectrum. the layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. the element can contain additional layers, such as filter layers, inter-layers, overcoat layers, subbing layers and the like.

In the following discussion of suitable materials for use in the elements of this invention, reference will be made to *Research Disclosure,* December 1978, Item 17643, published by Kenneth Mason Publications, Ltd., The Old Harbourmaster's, 8 North Street, Emsworth, Hampshire PO10 7DD, ENGLAND, and *Research Disclosure,* Dec. 1989, Item 308119, the disclosures of which are incorporated herein by reference. This latter publication will be identified hereafter by the term "Research Disclosure."

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB 1,027,146; JA 54/48,521; U.S. Pat. No. 4,379,837; U.S. Pat. No. 4,444,877; U.S. Pat. No. 4,665,012; U.S. Pat. No. 4,686,178; U.S. Pat. No. 4,565,778; U.S. Pat. No. 4,728,602; U.S. Pat. No. 4,668,614; U.S. Pat. No. 4,636,461; EP 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and group VIII noble metals, can be present during precipitation of the silver halide emulsion.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated.

Typical chemical sensitizers are listed in *Research Disclosure,* Items 17643 and 308119, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* Items 17643 and 308119, cited above, Section IV.

Suitable vehicles for the emulsion layers and other layers of elements of this invention are described in *Research Disclosure* Items 17643 and 308119, Section IX and the publications cited therein.

In addition to the couplers described herein the elements of this invention can include additional couplers as described in *Research Disclosure,* Items 17643 and 308119, Section VII, and the publications cited therein. These additional couplers can be incorporated as described in the above *Research Disclosure* and the publications cited therein.

The photographic elements of this invention can contain brighteners (*Research Disclosure* Items 17643 and 308119 Section V), antifoggants and stabilizers (*Research Disclosure* Items 17643 and 308119 Section VI), antistain agents and image dye stabilizers (*Research Disclosure* Items 17643 and 308119 Section VII, paragraphs I and J), light absorbing and scattering materials (*Research Disclosure* Items 17643 and 308119 Section VIII), hardeners (*Research Disclosure* Items 17643 and 308119 Section X), coating aids (*Research Disclosure* Items 17643 and 308119 section XI), plasticizers and lubricants (*Research Disclosure* Items 17643 and 308119 Section XII), antistatic agents (*Research Disclosure* Items 17643 and 308119 Section XIII), matting agents (*Research Disclosure* Items 17643 and 308119 Section XVI) and development modifiers (*Research Disclosure* Items 17643 and 308119 Section XXI).

Suitable stabilizers for the photographic elements of this invention include the following.

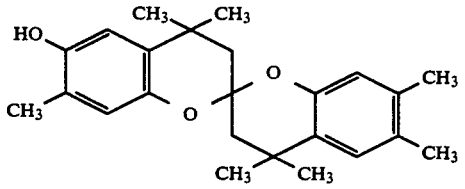

S-1

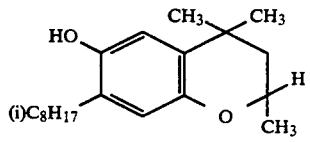

S-2

-continued
S-3
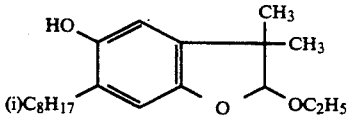
S-4
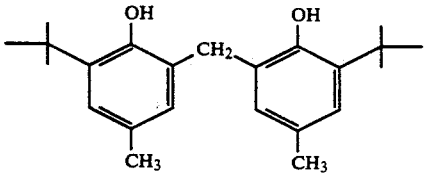
S-5
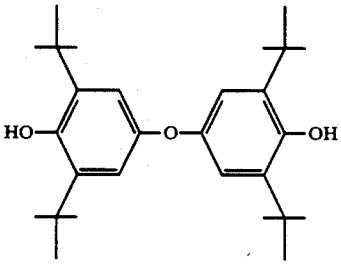
S-6
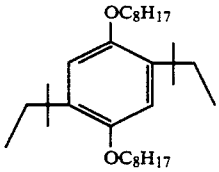
S-7
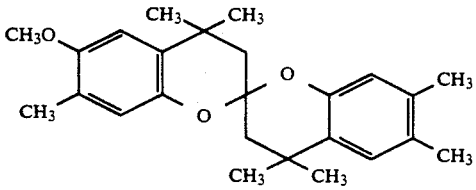
S-8
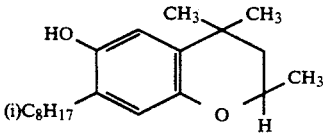
S-9
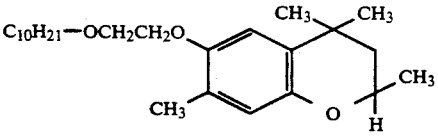
S-10
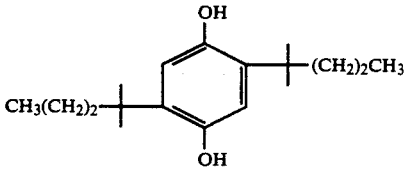
S-11
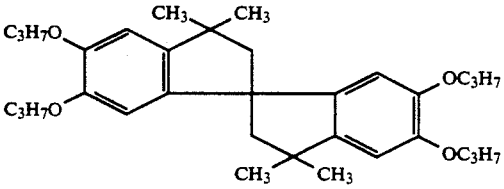
-continued
S-12
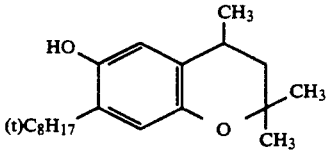
S-13
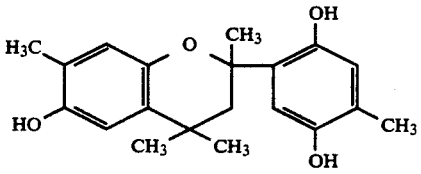
S-14
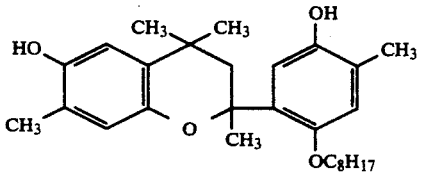
S-15
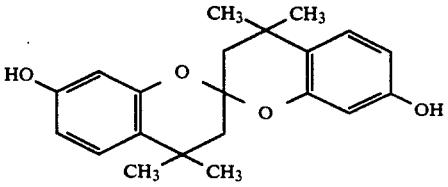
S-16
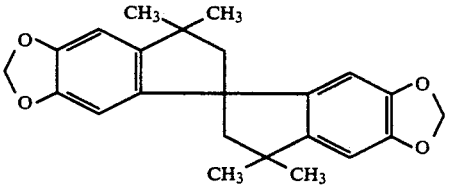
S-17
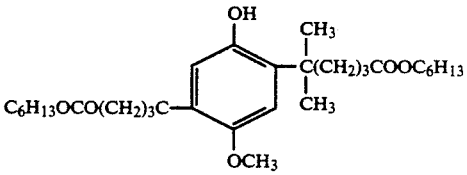
S-18
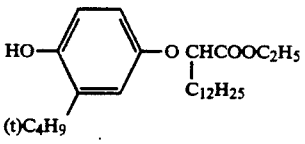
S-19
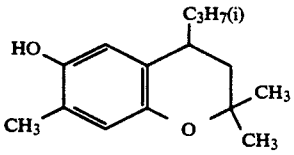
S-20
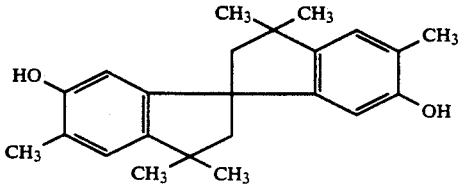

The photographic elements can be coated on a variety of supports as described in *Research Disclosure* Items 17643 and 308119 Section XVII and the reference described therein.

Photographic elements can be exposed to actinic radiation, typically in the visible region of the spectrum, to form a latent image as described in *Research Disclosure* Items 17643 and 308119 Section XVIII and then processed to form a visible dye image as described in *Research Disclosure* Items 17643 and 308119 Section XIX. Processing to form a visible dye image includes the step of contacting the element with a color developing agent to reduce developable silver halide and oxidize the color developing agent. Oxidized color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-b-(methanesulfonamido)-ethylaniline sulfate hydrate, 4-amino-3-methyl-N-ethyl-N-b-hydroxyethylaniline sulfate, 4-amino-3-b-(methanesulfonamido)ethyl-N,N-diethylaniline hydrochloride and 4-amino-N-ethyl-N-(2-methoxy-ethyl)-m-toluidine di-p-toluene sulfonic acid.

With negative-working silver halide, the processing step described above provides a negative image. The described elements can be processed in the known C-41 color process as described in, for example, the British Journal of Photography Annual of 1982, pages 209–211 and 1988, pages 191–198 or in known processes for processing color photographic papers, such as the known RA-4 of Eastman Kodak Company. The described elements are optionally processed in the known color processes for processing color print papers, such as the processes described in the British Journal of Photography Annual of 1988, pages 198–199. To provide a positive (or reversal) image, the color development step can be preceded by development with a non-chromogenic developing agent to develop exposed silver halide, but not form dye, and then uniformly fogging the element to render unexposed silver halide, but not form dye, and then uniformly fogging the element to render unexposed silver halide developable. Alternatively, a direct positive emulsion can be employed to obtain positive image.

Development is followed by the conventional steps of bleaching, fixing, or bleach-fixing, to remove silver or silver halide, washing, and drying.

The following examples further illustrate the invention.

Dispersions of the couplers were prepared in the following manner: The quantities of each component are found in Table I. In one vessel, the coupler, stabilizer (2,2',3,3'-tetrahydro-3,3,3',3'-tetramethyl-5,5',6,6'-tetrapropoxy-1,1'-spirobi[1H-indene]), coupler solvent (diethyl dodecanamide), and ethyl acetate were combined and warmed to dissolve. In a second vessel, gelatin, Alkanol XC (surfactant and Trademark of E. I. Dupont Co., U.S.A.) and water were combined and warmed to about 40° C. The two mixtures were mixed together and passed three times through a Gaulin colloid mill. The ethyl acetate was removed by evaporation and water was added to restore the original weight after milling.

TABLE I

| Dispersion No. (Coupler No.) | Grams Coupler | Grams Stabilizer | Grams Coupler Solvent | Grams Ethyl Acetate | Grams 24% Gelatin | Grams Alkanol XC (10% sol) | Grams Water |
|---|---|---|---|---|---|---|---|
| 1 - Inv. (M-1) | 0.974 | 0.487 | 1.46 | 2.922 | 9.69 | 2.33 | 20.89 |
| 2 - Comp. (C-1) | 0.903 | 0.452 | 1.36 | 2.710 | 9.69 | 2.33 | 21.32 |
| 3 - Comp. (C-2) | 0.954 | 0.477 | 1.43 | 2.863 | 9.69 | 2.33 | 21.01 |

Comparative Coupler 1

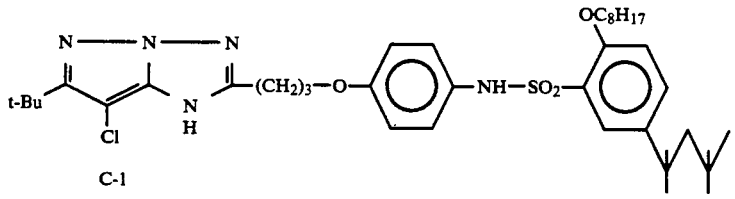

C-1

Comparative Coupler 2

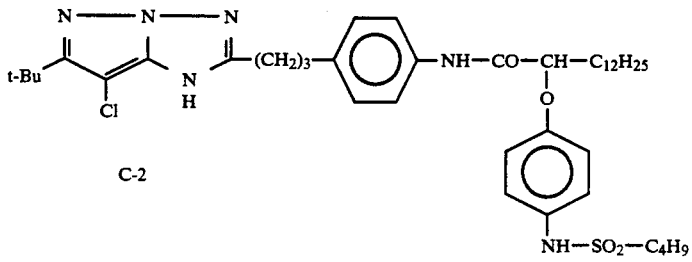

C-2

The photographic elements were prepared by coating the following layers in the order listed on a resin-coated paper support:

| | |
|---|---|
| 1st Layer | |
| Gelatin | 3.23 g/m$^2$ |
| 2nd Layer | |
| Gelatin | 1.61 g/m$^2$ |
| Coupler Dispersion (See Table II) coupler/m$^2$ | $4.3 \times 10^{-7}$ mole |
| Green-sensitized AgCl gelatin emulsion | 0.17 mg Ag/m$^2$ |
| 3rd Layer | |
| Gelatin | 1.33 g/m$^2$ |
| 2-(2H-benzotriazol-2-yl)-4,6-bis-(1,1-dimethylpropyl)phenol | 0.73 g/m$^2$ |
| Tinuvin 326 (U.V. absorber and trademark of Ciba-Grigg Corp., U.S.A) | 0.13 g/m$^2$ |
| 4th Layer | |
| Gelatin | 1.40 g/m$^2$ |
| Bis(vinylsulfonylmethyl)ether | 0.14 g/m$^2$ |

The photographic elements were given stepwise exposures to green light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| | |
|---|---|
| Developer | |
| Water | 700.00 mL |
| Triethanolamine | 12.41 g |
| Blankophor REU (made by Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl)ethylamino] ethyl}-methanesulfonamide, sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.4 ± 0.05 | |
| Bleach-Fix | |
| Water | 700.00 mL |
| Solution of ammonium thiosulfate (56.4%) + Ammonium sulfite (4%) | 127.40 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 6.7 | |

Magenta dyes were formed upon processing. The maximum density to green light ($D_{max}$), the wavelength of peak absorption at a density of 1.00, and the bandwidth in nanometers at half the peak density for each example are tabulated in Table II. Speed is defined as relative exposure required to give density of 1.00.

TABLE II

| Coupler | Dmax | Speed | Contrast | Wavelength | Bandwidth |
|---|---|---|---|---|---|
| M-1 | 2.44 | 144 | 2.59 | 547 | 90 |
| C-1 | 2.30 | 139 | 2.34 | 545 | 89 |
| C-2 | 2.29 | 137 | 2.52 | 546 | 90 |

The data show that the couplers of the present invention yield a higher maximum density, higher contrast and higher speed than the corresponding comparative couplers.

The invention has been described in detail with particular reference to preferred embodiments thereof, but it will be understood that variations and modifications can be effected within the spirit and scope of the invention.

What is claimed is:

1. A photographic element comprising a support bearing at least one photographic silver halide emulsion layer and a dye-forming pyrazolotriazole-based coupler, wherein the dye-forming coupler has a ballast-containing group of formula (I) attached to the pyrazolotriazole ring group:

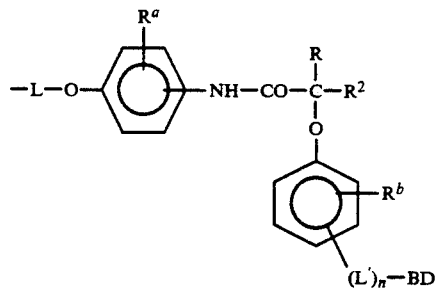

(I)

wherein: R and R$^2$ independently represent hydrogen or a substituent;

R$^a$ and R$^b$ independently represent hydrogen or a substituent;

L is a divalent linking group connecting the ballast containing group to the pyrazolotriazole ring;

L' is a linking group connecting the —BD group to the phenylene ring;

n is 0 or 1;

B represents —N(R$^c$)—SO$_2$—, wherein R$^c$ represents hydrogen or a substituent; and D represents substituted or unsubstituted alkyl.

2. A photographic element as in claim 1, wherein the coupler is represented by the formula (II):

(II)

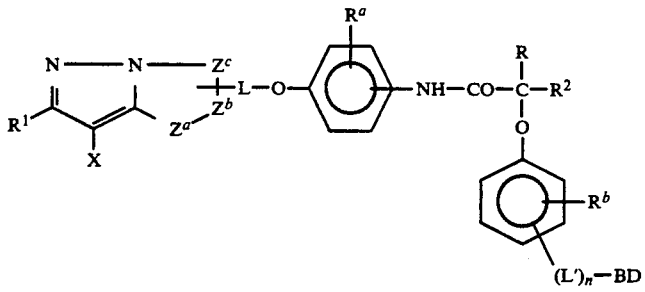

wherein: R, $R^2$, $R^a$, $R^b$, L, L', n, B and D are as previously defined;

$R^1$ is H or a substituent;

X is hydrogen or a coupling-off group; and $Z^a$, $Z^b$ and $Z^c$ are independently a substituted or unsubstituted methine group, =N—, =C— or —NH—, provided that one of either the $Z^a$—$Z^b$ bond or the $Z^b$—$Z^c$ bond is a double bond and the other is a single bond, and when the $Z^b$—$Z^c$ bond is a carbon-carbon double bond, it may form part of an aromatic ring, and wherein at least one of $Z^a$, $Z^b$ and $Z^c$ represents a methine group connected to group L.

3. A photographic element as in claim 2, wherein the coupler is represented by the formula (III):

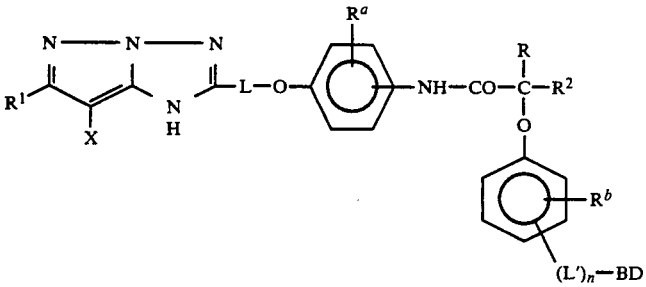

wherein: R, $R^2$, $R^a$, $R^b$, L, L', n, B, D, $R^1$ and X are as previously defined;

4. A photographic element as in claim 3, wherein the coupler is

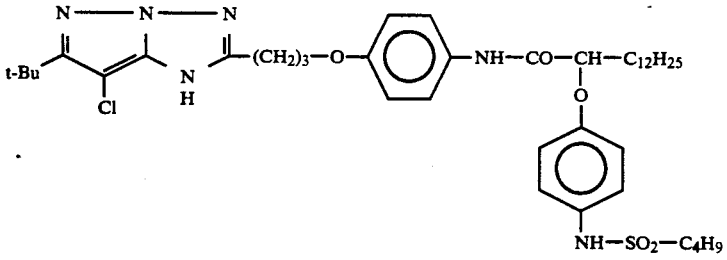

5. A photographic element as in claim 1, wherein D is alkyl having 1 to 24 carbon atoms.

6. A photographic element as in claim 5 wherein B is —NH—$SO_2$—.

7. A photographic element as in claim 6, wherein R is H and $R^2$ is alkyl having 1 to 32 carbon atoms.

8. A photographic element as in claim 6, wherein X is Cl or H.

9. A photographic element as in claim 6, wherein $R^1$ is alkyl having 1 to 16 carbon atoms.

10. A process of forming a dye image in an exposed photographic element comprising a support bearing at least one photographic silver halide emulsion layer, said process comprising developing the photographic element of claim 1 with a color silver halide developing agent in the presence of a pyrazolotriazole color coupler wherein said coupler has a ballast-containing group of formula (I) attached to a pyrazolotriazole ring group (I)

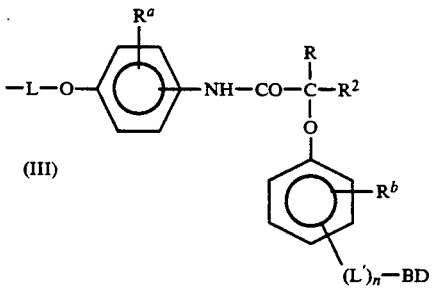

(III)

wherein R and $R^2$ independently represent hydrogen or a substituent;

$R^a$ and $R^b$ independently represent hydrogen or a substituent;

L is a divalent linking group connecting the ballast-containing group to the pyrazolotriazole ring;

L′ is a linking group connecting the —BD group to the phenylene ring;

n is 0 or 1;

B represents —N($R^c$)—$SO_2$—, wherein $R^c$ represents hydrogen or a substituent; and D represents substituted or unsubstituted alkyl.

11. A process as in claim 10, wherein the coupler is represented by the formula (III):

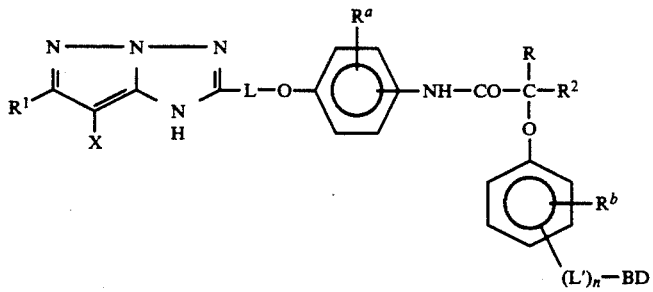

(III)

wherein: R, $R^2$, $R^a$, $R^b$, L, L′, n, B and D are as previously defined;

$R^1$ is H or a substituent; and

X is hydrogen or a coupling-off group.

12. A process as in claim 10, wherein the coupler is

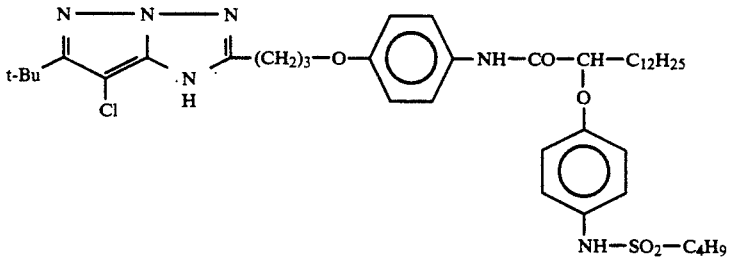

* * * * *